US005291757A

United States Patent [19]

Wanger

[11] Patent Number: 5,291,757

[45] Date of Patent: Mar. 8, 1994

[54] DEVICE FOR HEAT TREATMENT AND/OR HUMIDIFICATION OF SPOOLS, COPS AND CONES

[76] Inventor: Freddy Wanger, Riedmatte 11, CH-5452, Oberrohrdorf, Switzerland

[21] Appl. No.: 741,439

[22] PCT Filed: Dec. 20, 1990

[86] PCT No.: PCT/CH90/00289

§ 371 Date: Aug. 6, 1991

§ 102(e) Date: Aug. 6, 1991

[87] PCT Pub. No.: WO91/10002

PCT Pub. Date: Jul. 11, 1991

[30] Foreign Application Priority Data

Dec. 22, 1989 [CH] Switzerland ..... 4631/89

[51] Int. Cl.[5] ..... D06B 3/04

[52] U.S. Cl. ..... 68/5.00 C; 68/5 D

[58] Field of Search ..... 68/5 C, 5 D, 5 E; 8/149.3

[56] References Cited

U.S. PATENT DOCUMENTS 488,267 12/1892 Klug ..... 68/5 C
1,103,806 7/1914 Mertz ..... 68/5 C
1,128,451 2/1915 Jefferson ..... 68/5 C
1,941,087 12/1933 Hejdur et al. ..... 68/5 C
2,915,230 12/1957 Brewin et al. ..... 68/5 C
4,893,403 1/1990 Kawasaki et al. ..... 68/5 D
4,953,368 9/1990 Kawasaki et al. ..... 68/5 D

FOREIGN PATENT DOCUMENTS 256017 8/1967 Austria ..... 68/50

*Primary Examiner*—Frankie L. Stinson
*Attorney, Agent, or Firm*—Schweitzer Cornman & Gross

[57] ABSTRACT

A device for heat treatment, in particular for steaming of spools, cops and cones, based on an elongated, height-adjustable steaming vessel (2), arranged below, and parallel to, spools (15) suspended in a row. By being moved into the steaming vessel (2), the spools (15) can be unlatched and, after closing of a lid (7), heat treated.

Alternatively, a closed, conduit-like steaming vessel can be included in the material flow of the spools, permitting steaming in the throughfeed mode.

The dwell times of the cops after steaming are largely predeterminable. Also, the space requirements of the equipment are minimal.

13 Claims, 5 Drawing Sheets

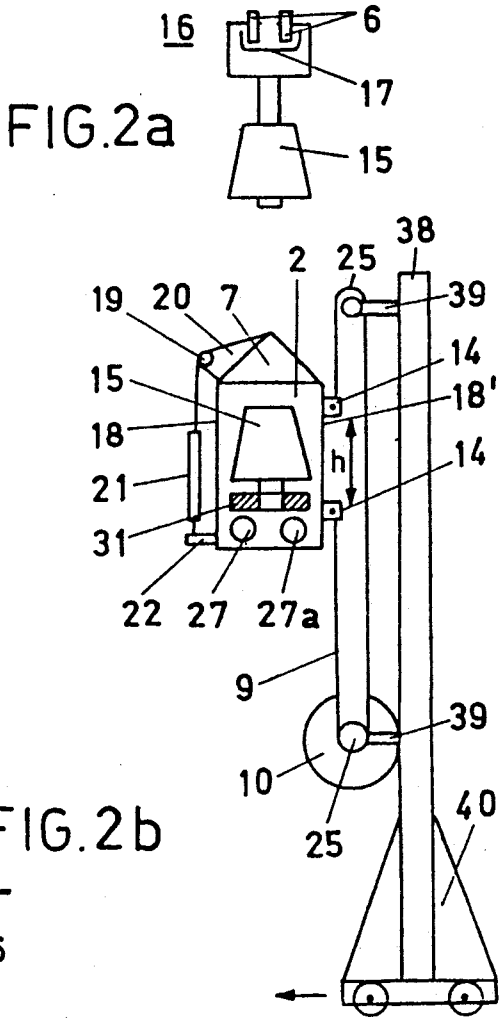
FIG.2a
FIG.2b
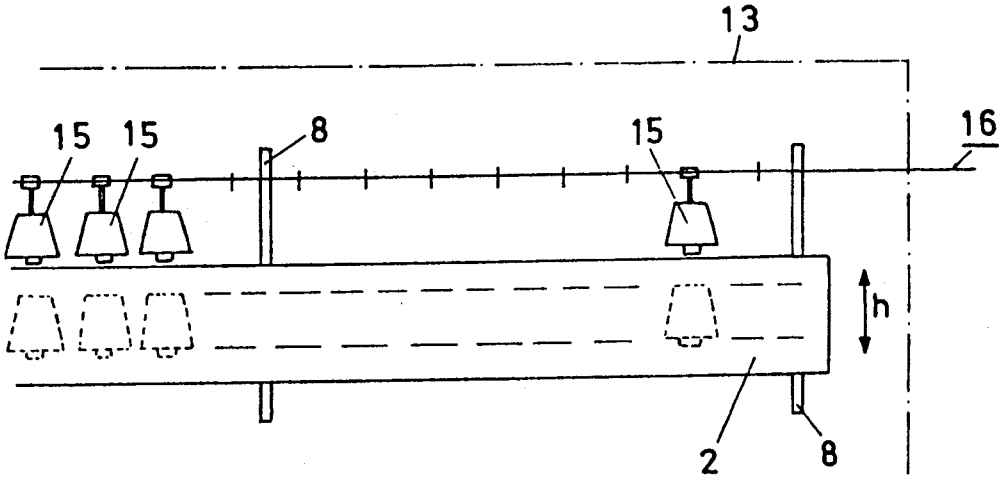
FIG.1
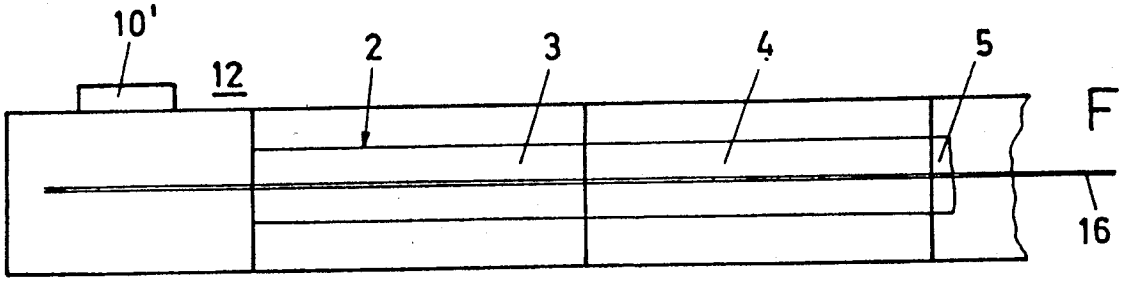
FIG.3

DEVICE FOR HEAT TREATMENT AND/OR HUMIDIFICATION OF SPOOLS, COPS AND CONES

The present invention relates to a device for heat treatment and/or humidification of spools, cops and cones, in which an elongated, evacuatable steaming vessel is provided.

In spinning mills it has been a long-known practice to steam yarns. Particularly useful were found to be steaming vessels in which the cops were arranged above a heated water bath in a saturated-steam atmosphere. For this purpose, the cops must be removed from the spinning machine, treated in the steaming vessel and then moved to the winding machine. In the known devices, this necessitated a special transport system which required a great deal of space. In addition, the system increased the risk of material mix-up.

It is the object of the invention to provide a device for heat treatment and/or humidification of cops which involves as low an expenditure as possible and requires as little additional space as possible and which furthermore facilitates optimal integration of the material flow into the production process and minimizes the required conveying paths.

This object is achieved in that the steaming vessel is configured to be conduit-shaped and height-adjustable, or that the steaming vessel is in the form of an enclosed conduit open at both its end faces, and that these end faces are contiguous with at least one conveyor.

Both embodiments of the invention facilitate the adapting of the heat treatment process to textile machinery and to integrate this process into the material flow.

The subsequent dependent claims characterize further advantageous developments of the object of the invention.

Entrance of steam into the steaming vessel can be interrupted by shutting off the steam access openings in a simple manner by two perforated sheet-metal strips slidable one relative to the other, claim 3.

Control of the water quantities is effected in an equally simple way according to claim 4.

In its opened state, the lid of the steaming vessel will not interfere with the movement of the cops into the steaming vessel or from the steaming vessel to the conveyor, if the steaming vessel is provided with a lid articulated by means of a hinge to that lateral wall of the steaming vessel that faces the spinning stations, as claimed in claim 5.

A particularly simple design is achieved if, according to claim 6, the lid is configured to be actuatable by means of a lifting cylinder attached to the lateral wall and to a cantilever arm of the lid.

In order to reduce mass with a height-adjustable steaming vessel, a design according to claim 7 is recommended, in which the lid is slid closed and open via a horizontal cantilever arm.

The steaming vessel can be adapted to machinery of differing dimensions at low costs if the steaming vessel is modularly assembled from several elements which, assembled one after the other, form in their totality the conduit-like steaming vessel (claim 8).

The separate elements can be optimally designed according to the further advantageous development as recited in claim 9.

According to claim 10, the steaming conduit is rendered autonomous and particularly light-weight by an external steam generator which can be arranged according to choice.

A design according to claim 11 reduces heat losses in the steaming vessel.

By a design according to claim 12, it is possible to produce a vacuum also in steaming vessels having open ends. According to charge sizes and cycle times, this makes it also possible to optimize process flow.

Particularly simple are conveyors with guide rails accommodating sliding bodies according to claim 13.

The separate zones or chamber segments in the steaming vessel are preferably supplied as claimed in claim 14.

The arrangement, in the closable steaming vessel, of the guide rail as claimed in claim 15, from which rail the cones or cops are suspended with the aid of travelling crabs, has the advantage that it eases the introduction of the cops or cones. By arranging several guide rails, utilization of the steaming vessel can be improved.

The hot-air nozzles according to claim 16 prevent water condensation at the travelling crabs and, thus, soiling of the cops or cones.

The tiltable guide rails according to claim 17 simplify the introduction of the cops into the steaming vessel.

In the following, the object of the invention is explained in greater detail with the aid of drawings, in which:

FIG. 1 shows a height-adjustable steaming conduit arranged below a conveyor, in front of a spinning machine;

FIG. 2*a* illustrates the crab of a conveyor with a cone suspended therefrom;

FIG. 2*b* shows a height-adjustable steaming conduit arranged on a stand;

FIG. 3 is a schematic representation of a spinning machine with a steaming conduit located thereabove;

Figure 4:
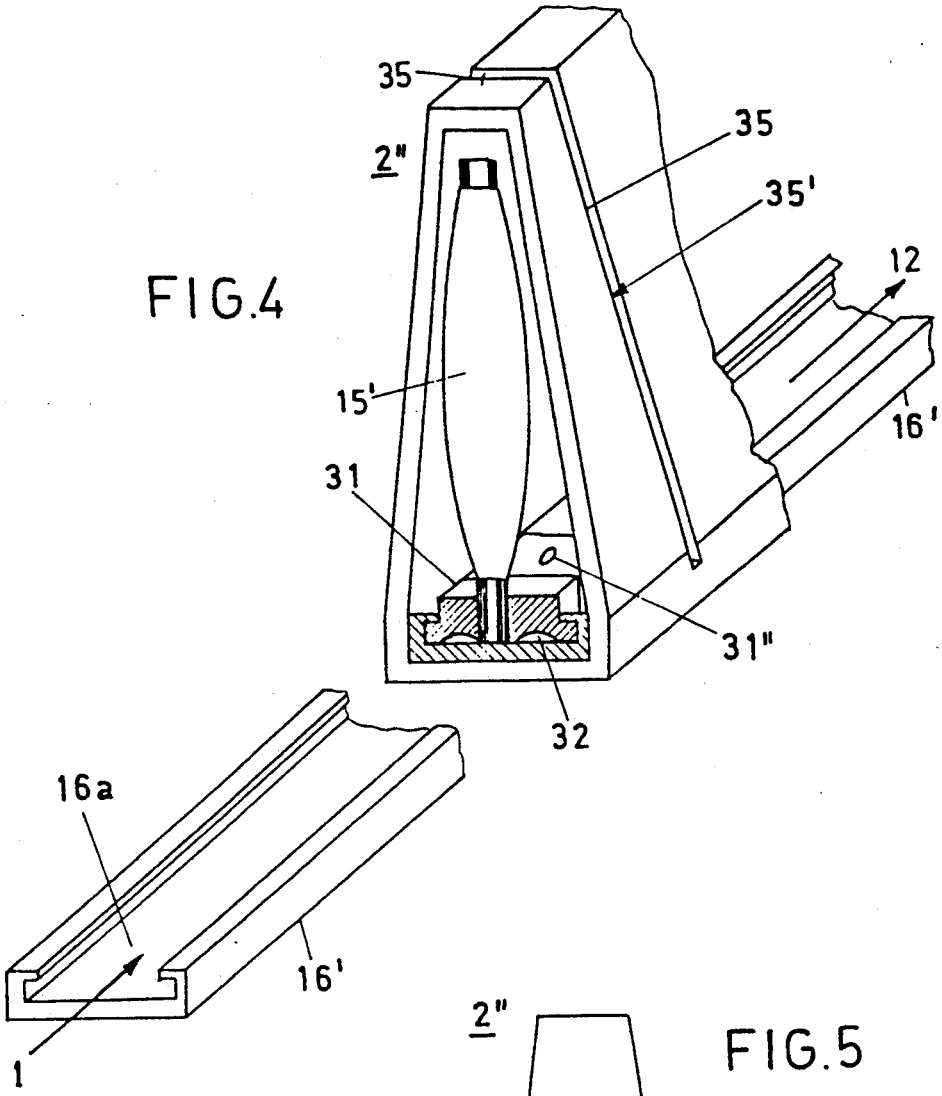
FIG. 4 shows a closed steaming vessel for throughfeed processes.

FIG. 1 schematically represents a height-adjustable steaming vessel 2 disposed in front of a spinning machine 13 and vertically guided on guide rails 8. Above the steaming vessel there is located a conveyor 16, a rail with travelling crabs from which are suspended cones 15.

The design of the conveyor 16 is seen in greater detail in FIG. 2*a*, with two rollers 6 guided in an appropriately shaped guide rail 17.

The height adjustment of the steaming vessel is best understood from FIG. 2*b*. The as such autonomous steaming vessel 2 is provided with a lid 7 articulated by means of a hinge 19 to a lateral wall 18 of the vessel 2 and actuable by means of a lifting cylinder 21 attached to the lateral wall 18 and to a cantilever arm 20. Via a cable 9 with drive motor 10 and deflection pulleys 25, the entire steaming vessel 2, supported by carriers 14 and with the lid 7 open, is raised to such a height that the cops 15 on the conveyor 16 (FIG. 2*a*) unlatch in an as such known manner and are centered in one sliding and supporting body 31 each. By its stand 38 with its supports 39 and ribs 40, the arrangement of FIG. 2*a* has been rendered autonomous. The supply lines to the risers 27, 27*a* (steam and vacuum) are led via flexible tubing to a supply unit (not shown).

A further steaming vessel 2 is similarly arranged above a winding machine 12, FIG. 3, being located in the plane of symmetry together with the conveyor disposed above it. In this embodiment, the steaming vessel 2 is modularly composed of separate elements, a head element 3, intermediate elements 4 and 5, as well as of a terminal element not shown. This, at the same time, affords a solution to problems of thermal expansion. A steaming and vacuum device 10' is located adjacent to the winding machine 12, and the feeding lines (not shown) are led to the elements of the steaming vessel 2.

Figure 5:
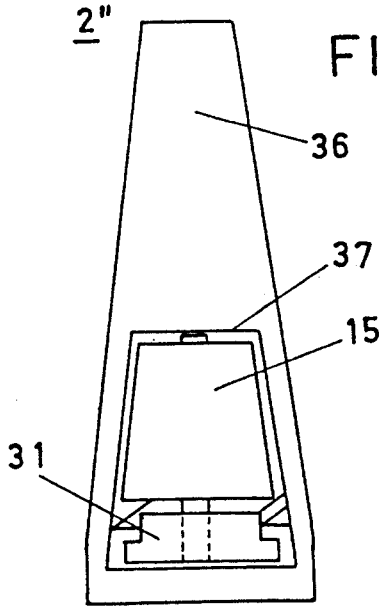
FIG. 5 represents the end face of a steaming vessel for cones.

FIGS. 4 and 5 illustrate a conduit-like steaming vessel 2'' built into the material flow between a spinning machine 1 and a winding machine 12. A conveyor 16', a guide rail with an undercut, T-slot profile 16*a*, leads through an upwardly closed steaming conduit 2''. Sliding bodies 31 carry in FIG. 4 cops 15' and are periodically pushed through the conduit. To reduce frictional resistance, the sliding bodies are provided with recesses 32 which, according to the system, may also serve for conveying by means of cog wheels.

The subdividing of the conduit-like steaming vessel 2'' into separate chamber segments adapted to the process is effected by the insertion, into slots 35 extending across the steaming space, of flat sliding gates 35' (not shown).

According to the cop, spool or cone to be treated, each sliding body 31 is provided with bores or supporting pegs 31''.

By providing end-face coverings 36, FIG. 5, the openings 37 of which fit the shape of the body to be steamed, here a cone 15, heat and flow losses can be reduced.

Figure 6:
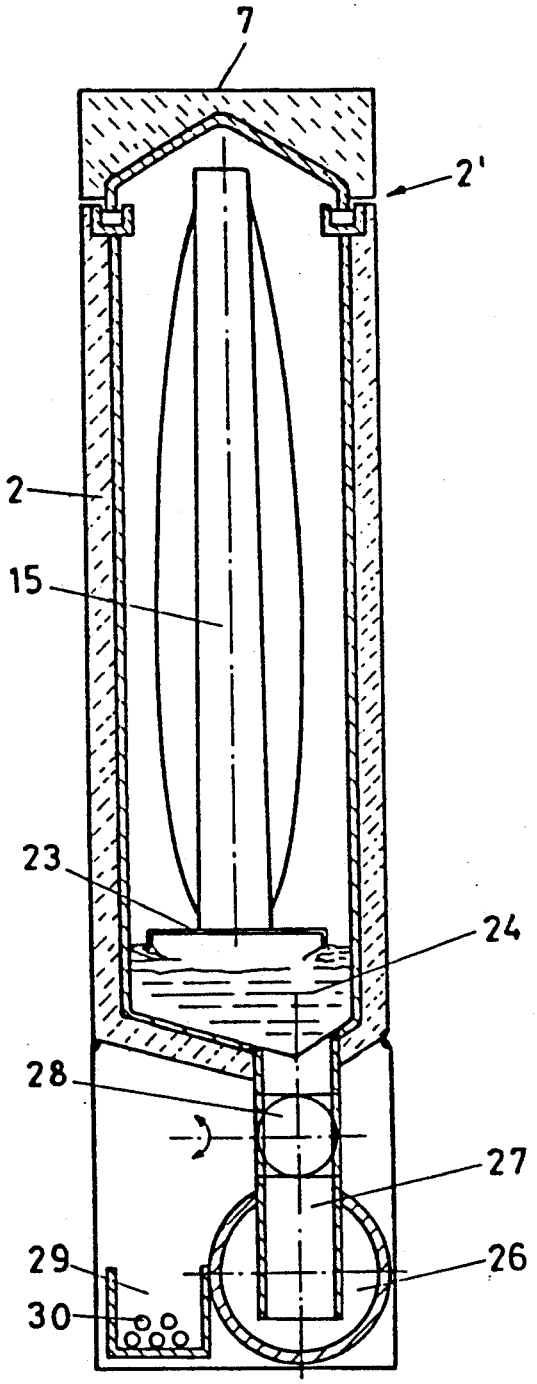
FIG. 6 is a vertical cross-section of an example of a steaming vessel.

The steaming vessel 2, FIG. 6, has a water duct 26 of a circular cross-section, from which a riser 27 leads upwards into the water-bath space 24 of the steaming vessel 2. A shut-off valve 28 serves for opening and closing the riser 27. The water-bath cover 23 serves for supporting cops 15 introduced into the steaming vessel 2. Further seen in FIG. 6 is a cable duct 29, extending parallel to the water duct 26 and accommodating electrical lines. Also seen, in the region of the lid 7, are sealing elements 2'.

Figure 7:
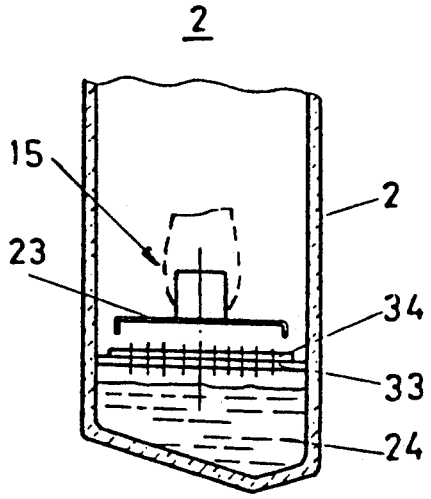
FIG. 7 is a vertical cross-section of the lower portion of a variant of the steaming vessel of FIG. 6.

In the embodiment according to FIG. 7, the water-bath space 24 is covered by two superposed perforated sheet-metal strips 33, 34. While the lower perforated strip 33 is fixedly attached to the wall of the steaming vessel, the upper strip 34 can be slid upon the lower perforated strip 33 in the longitudinal direction thereof. This enables the water-bath space 24 to be shut off from the rest of the internal space of the steaming vessel 2. The water-bath cover 23 serves here also as support for the cops 15 (not shown in FIG. 7).

Figure 8:
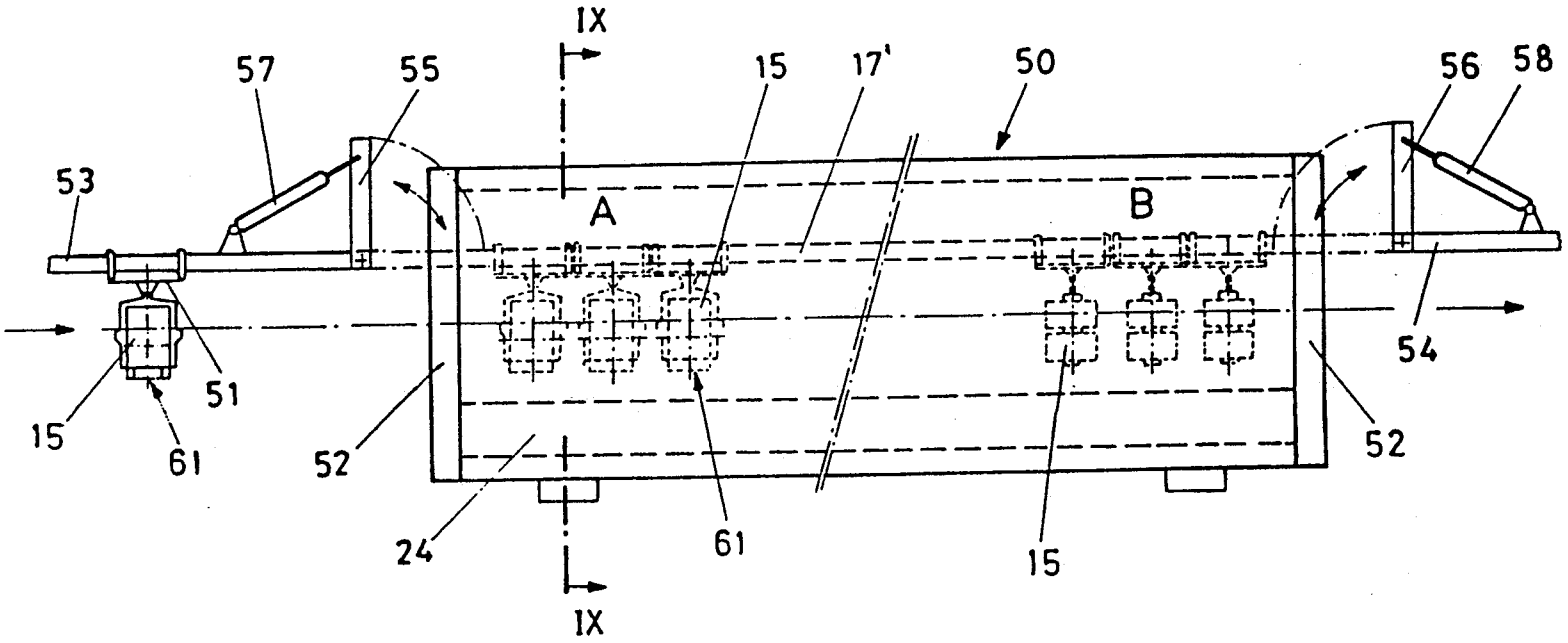
FIG. 8 is an elevational view of an enclosed tubular steaming vessel for throughfeed processes according to another embodiment.
Figure 9:
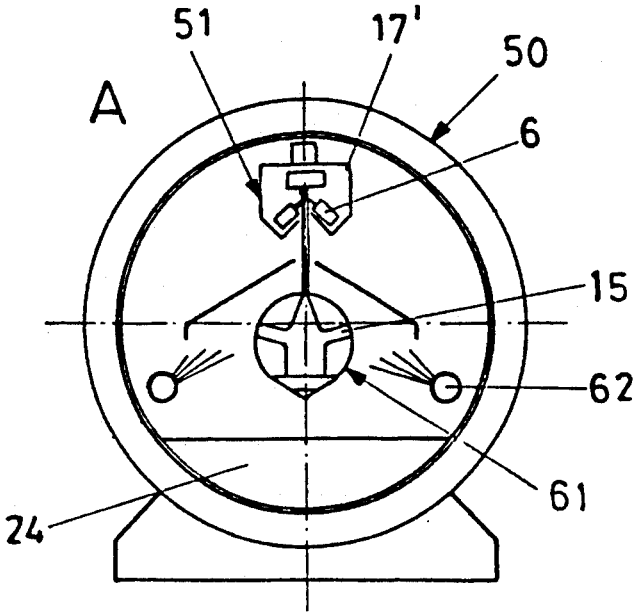
FIG. 9 represents a view, in cross-section along plane IX—IX, of the steaming vessel shown in FIG. 8.

As seen in FIGS. 8 and 9, the steaming vessel 50 is of a tubular shape and comprises in its interior a guide rail 17' such as already shown in FIG. 2*a*. On these guide rails 17' it is possible to lead travelling crabs 51 with cops 15 through the steaming vessel 50. This steaming vessel 50, as shown in FIGS. 1 and 2*b*, can be raised and lowered. At both of its ends, the steaming vessel 50 can be closed off by detachable lids 52. In the position of the steaming vessel 50 shown in FIG. 8, the guide rail 17' is at the same height as two further guide rails 53 and 54 arranged to the right and to the left of the steaming vessel 50, i.e., the guide rail 17' is in alignment with the guide rails 53 and 54. To the ends of these two guide rails 53 and 54 are articulated, one at each end, tiltable guide-rail sections 55 and 56 which, as indicated by dash-dotted lines, can be folded down, so that the travelling crabs 51 can be moved from the guide rail 53 via the guide-rail section 55 onto the guide rail 17' in the interior of the steaming vessel 50. Subsequently, the travelling crabs 51 can be shifted from the guide rail 17' in the interior of the steaming vessel 50 via the guide-rail sector 56 onto the right-hand guide rail 54, as soon as the steaming process in the interior of the steaming vessel 50 is concluded.

For folding down the two guide-rail sections 55 and 56, two actuating cylinders 57 and 58 are provided, which cylinders are tiltably articulated to the guide rails 53 and 54, respectively. Each actuating cylinder 57, 58 has a piston which, via a piston rod, is articulated to the appropriate guide-rail section 55 or 56. However, before the guide-rail sections 55 and 56 can be folded down, the two lids 52 at the two ends of the steaming vessel 50 must be removed. Below the cops or spools 15 there is located a water-bath space 24, as already described in detail in conjunction with FIGS. 6 and 7.

Figure 10:
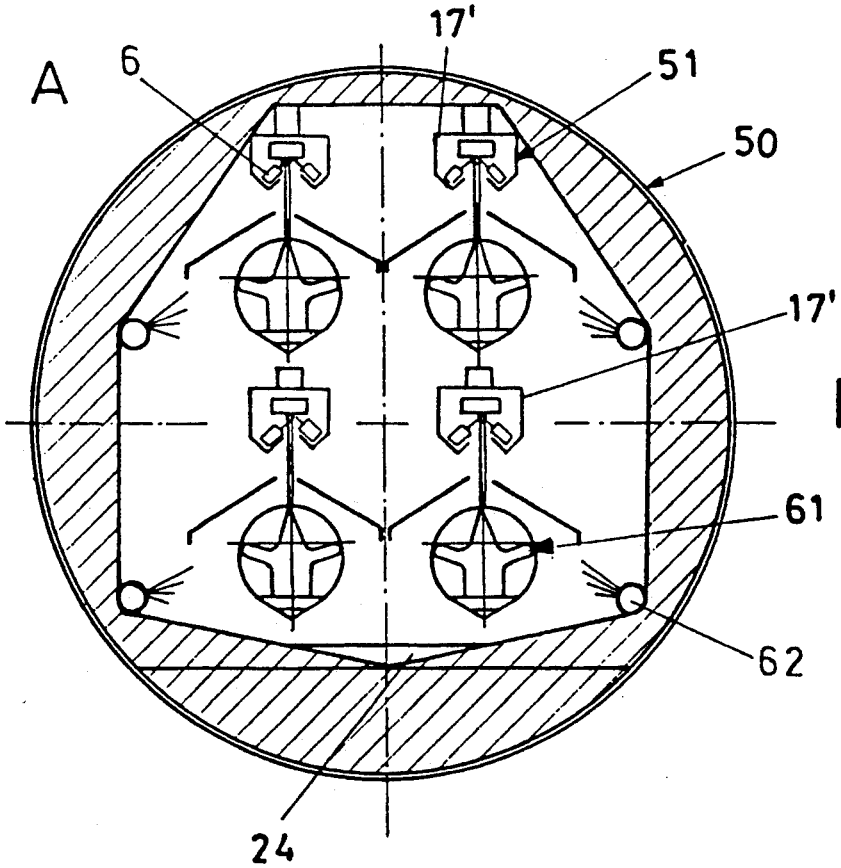
FIG. 10 is a cross-sectional view of a steaming vessel through which are led, parallel to one another, several travelling crabs as shown in FIGS. 1 and 2*a*.

The steaming vessel 50 according to FIG. 10 differs from that illustrated in FIG. 9 in the main only by the provision, in the interior of the steaming vessel, of four parallel guide rails 17' instead of the single guide rail 17'. These guide rails 17' can then, all at the same time, be filled with cops or spools 15 or, using the guide rail 53 shown in FIG. 8 and the guide-rail section 55, one after the other of the guide rails 17' in the interior of the steaming vessel 50 can be filled with cops 15 disposed in baskets 61.

As seen in FIGS. 9 and 10, the spools 15 are located in baskets 61 which are suspended from the travelling crabs 51. With these crabs 51, too, the rollers 6 are guided in an appropriate guide rail 17'. However, as opposed to the rollers shown in FIG. 2*a*, the rollers shown in FIGS. 9 and 10 are arranged to be slanting, which ensures better guiding.

Condensation of water on the travelling crabs 51 or on the baskets 61 is prevented with the aid of hot-air nozzles 62, as seen in FIGS. 9 and 10.

The basic parameters of the process, the selection of steam pressure, temperatures and the admixture of possible chemicals are known, especially for yarns. Compare Freddy Wanger, Chemiefasern/Textilindustrie, Vol. 30/82, 1980, pp. 888–890; Melliand Textilberichte 66, 1985, pp. 525–526; Textilbetrieb, Vogel-Verlag Wuerzburg, 1981, Heft 7/8. The object of the invention can be adapted to fit all process and operational conditions.

Obviously, the term "heat treatment" as used in the patent claim also refers to sterilization processes such as applied during the manufacture of, e.g., hygiene articles, bandages, compresses and the like.

I claim:

1. A device for the heat treatment and/or humidification of textile items in a textile treatment system having a conveyor on which said textile elements are transported on individual spools, cops or cones; comprising an elongated vessel positioned proximate a portion of the conveyor and having a body and a lid operable to accept said textile elements within the vessel body; means mounted to said vessel for vertically positioning said vessel in a first position in which at least one of said textile items on said conveyor is located within said vessel body and for transporting said vessel and said at least one textile item vertically to a second position remote from said conveyor; and means coupled to said vessel for providing heat or steam thereto when said vessel is in said second position.

2. The device according to claim 1 characterized in that said vessel body comprises a steaming chamber arranged above a water duct, said duct being connected to said chamber by a plurality of risers having shut-off valves.

3. The device accordingly 1 further comprising hinge means mounted to a lateral wall of said vessel body for articulating said lid and locking said lid in a closed position.

4. The device accordingly to claim 3 further comprising a lifting cylinder attached to said lateral wall and to a cantilever arm, said arm being affixed to said hinge.

5. The device according to claim 1, wherein said lid is horizontally slideable and lockable to said vessel body.

6. The device according to claim 1, wherein said vessel body is comprised of a plurality of elements, said elements being arranged along the length of said vessel.

7. The device according to claim 6, wherein said steaming vessel body comprises a head element, at least one intermediate element and a terminal element, said head element comprising vacuum and airing line connectors, at least one temperature sensor, at least one pressure sensor, a feed water connector and a lid drive; each intermediate element comprising a heating element, and a water level sensor connector; said terminal element comprising a heating element, and a ventilation connector; said lid having at least one intermediate element-covering portion and an independent terminal element-covering portion.

8. The device according to claim 7 further comprising a steam generator mounted outside said steaming vessel and means connecting the output thereof to said vessel.

9. The device according to claim 1, characterized in that, in the steaming vessel (2), there are provided guide rails for sliding bodies with central pegs.

10. The device according to claim 1, characterized in that, in the steaming vessel (2), there are provided aeration and de-aeraation means.

11. The device according to claim 1, characterized in that at least one guide rail (17') is located in a conduit-like steaming vessel (50) closable at its ends, from which guide rail (17') the cones or cops (15) are suspended with the aid of travelling crabs (51).

12. The device according to claim 1, characterized in that hot-air nozzles (62) are provided in the region of the travelling crabs (51) to prevent formation of condensation water.

13. The device according to claim 1, characterized in that, via tiltable guide-rail sections (55 and 56), the guide rail (17') in the steaming vessel (2) can connected with guide rails (53, 54) located outside of the steaming vessel.

* * * * *